United States Patent [19]

Beauchemin

[11] 4,004,969

[45] Jan. 25, 1977

[54] PAPER MACHINE DRAINAGE FOIL WITH WEAR-RESISTANT INSERT

[75] Inventor: Norman J. Beauchemin, Shrewsbury, Mass.

[73] Assignee: Lodding Engineering Corporation, Auburn, Mass.

[22] Filed: Nov. 5, 1975

[21] Appl. No.: 629,024

[52] U.S. Cl. ..... 162/352; 162/374

[51] Int. Cl.[2] ..... D21F 7/00

[58] Field of Search ..... 162/352, 374

[56] References Cited

UNITED STATES PATENTS

| | | | |
|---|---|---|---|
| 3,732,142 | 5/1973 | Beacom et al. | 162/374 |
| 3,778,342 | 12/1973 | Charbonneau | 162/374 X |
| 3,870,597 | 3/1975 | Getman et al. | 162/352 |

*Primary Examiner*—Robert L. Lindsay, Jr.
*Assistant Examiner*—Richard V. Fisher
*Attorney, Agent, or Firm*—Alfred H. Rosen; Frank A. Steinhilper

[57] ABSTRACT

Drainage foils are described in two parts, a first part including the drainage surface and means for mounting the foil on a support, and the second part including the land surface and the leading edge. The second part is fitted with wear-resistant material, and is removably fitted to the first part, so that the two parts can be interchanged to facilitate changing foiling angles and land surfaces in a given installation.

7 Claims, 6 Drawing Figures

PAPER MACHINE DRAINAGE FOIL WITH WEAR-RESISTANT INSERT

BACKGROUND OF THE INVENTION

This invention relates to web forming machines, such as Fourdrinier type paper machines wherein a pulp and water slurry is deposited onto a moving drainage or forming wire, and more particularly relates to drainage foils which are positioned in stationary supporting engagement beneath the moving drainage wire for purposes of increasing the drainage of water through the wire.

Such foils are well known and include a transverse leading edge which doctors or scrapes water from the underside of the moving wire, a land portion over which the wire passes, and a foiling portion which extends in a downstream direction from the land portion and at a divergent angle to the wire. The action of the foiling portion is to produce a suction, beneath the moving wire, which draws water through the wire. The leading edge of the adjacent downstream foil then scrapes this water from the underside of the wire. The suction force along the foiling portion causes the moving wire to be urged downwardly thus increasing the drag of the wire moving over the land portion. This increased drag causes rapid wear of the land portion thereby increasing the area of the land portion and moving the foiling area in a down-stream direction towards the trailing edge. Eventually, after prolonged wear, the increased area of the land portion will result in reduction in the area of the foiling portion to the point where the effective suction and drainage action is impaired. Additionally, the land portion wears irregularly across the width of the machine, which again causes unsatisfactory operation.

U.S. Pat. No. 3,165,440 - Jordansson - proposes one solution to the problems resulting from this kind of wear, which is to reverse the foil on its support. U.S. Pat. No. 3,446,702 - Buchanan - proposes another solution, which is to fit the foil with a wear insert, the object being to provide foils which have a high degree of resistance to wear. The present invention is directed to foils of the latter kind. Others have given attention to providing such foils, and the results have taken various forms, as disclosed for example in U.S. Pat. Nos.: 3,393,124 - Klinger et al; 3,778,342 - Charbonneau; 3,352,749 - Perry; 3,793,140 - Corbellini; and 3,105,789 - Goddard.

BRIEF DESCRIPTION OF THE INVENTION

In the present invention a drainage foil is provided for use in a paper machine having a traveling screen for supporting water-wet pulp during the drainage of water therefrom, the foil intended to extend lengthwise transversely under the screen and having a leading edge for initial contact with said screen, followed in the direction of travel of the screen by an upward-facing land surface in supporting relation thereto, the land surface being followed in said direction of travel by a drainage surface diverging from the underside of the screen to control the drainage of water from said pulp, in which the foil comprises a first body defining the drainage surface and a second body defining all of the land surface from the leading edge to the beginning of the drainage surface, and in which the land surface is covered at least in part with a wear-resistant material that is permanently affixed to the second body and is harder than the material of the second body, there being an elongated channel running the length of the first body, and wherein the second body is removably disposed within that channel. The materials of the first and second bodies may be chosen with regard to intended use, and economic conditions; thus the material of the first body can be a high density, preferably high molecular weight polyethylene, and the material of the second body can be a suitable corrosion-resistant metal such as stainless steel, while the wear-resistant material may be a ceramic, all of these materials being known per se.

In a preferred embodiment of the invention, the first body has a forward surface extending downwardly relative to the drainage surface, the upper edge of that forward surface being spaced from the forward edge of the drainage surface to define the boundaries of an elongated opening into the elongated channel and extending the full length of the foil, and the channel extends into the first body intermediate those two surfaces from the elongated opening. The second body is an elongated slab of solid material having first and second wide sides that are substantially parallel to each other, and a third side joining the first side at an acute angle and joining the second side at an obtuse angle, the land surface being on the third side, and the second body is installed in the first body with its first side nearer to the forward surface of the first body than the second side, with the result that the first and third sides of the second body meet at said acute angle to form the leading edge of the drainage foil, and the second and third sides of the second body meet at a line that coincides substantially with the forward edge of the drainage surface of the first body.

The channel and the second body are fitted with cooperating means to retain the second body in the channel against force oriented to move the second body out of the channel through the elongated opening thereof. In a preferred embodiment of the invention, the elongated channel in the first body has first and second side walls and a bottom wall, and first and second auxiliary slots extending in opposite directions, respectively, substantially perpendicularly into the first and second side walls, and the second body is fitted with retainer means extending, respectively, from its first and second wide sides into the first and second auxiliary slots to retain the second body in the channel against such force. The retainer means may comprise an array of discrete projections spaced in a line along each of the first and second wide sides of the second body. Preferably, the elongated channel and the auxiliary slots open through at least one end of the first body, and the second body is slidably movable in the elongated direction within the channel, and in this way one second body can be exchanged for another in a given first body, or vice versa.

The second body can be fitted with wear resistant material in various fashions. According to one embodiment of the invention, the third side and a portion of the first wide side immediately adjacent to the third side are covered with a wear resistant material. According to another embodiment, the third side has a step-wise change in level along a line running parallel to its edges, that line being nearer to the first wide side than to the second wide side, the portion of the third side between that line and the second wide side being covered with a wear-resistant material the outer surface of which is substantially coplanar with the portion of the third side between that line and the first side.

Suitable wear resistant materials, and methods of applying them to the second body, are per se known, and some are identified more particularly hereinafter.

DETAILED DESCRIPTION OF THE DRAWINGS

Figure 1:
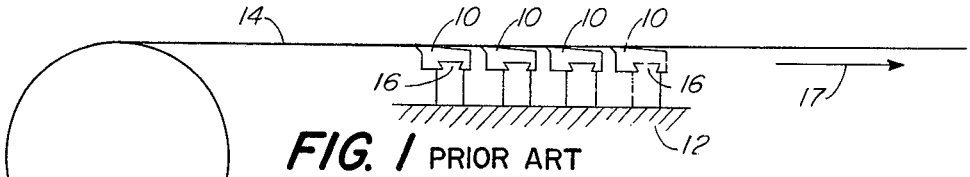
FIG. 1 PRIOR ART
FIG. 1 is a schematic section of a Fourdrinier machine showing a set of foils in operative position under the forming wire.
Figure 2:
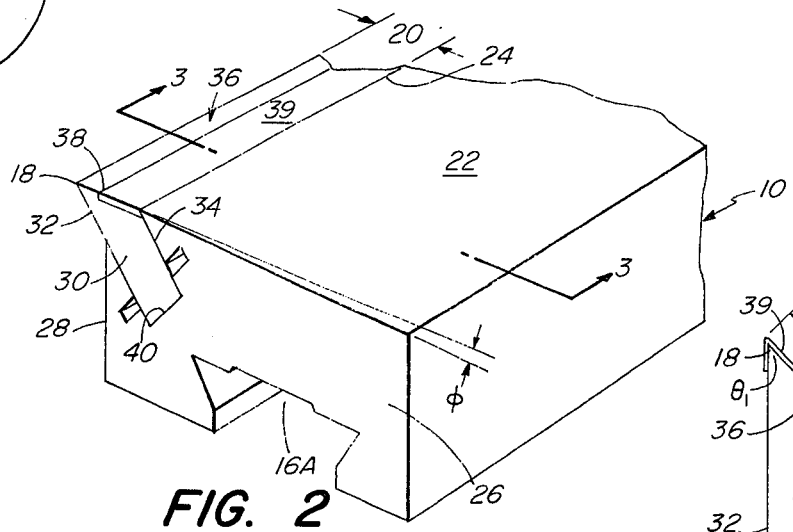
FIG. 2 is an enlarged isometric view of a foil according to the invention.

As is shown in FIG. 1, the foils 10 are mounted on suitable rigid support means 12 beneath the forming wire 14, for example, by means of the dovetail slide 16 which is fully described in U.S. Pat. Nos. 3,645,844 and 3,713,610. As is shown in FIG. 2, each foil has a leading edge 18, a land or wire-supporting surface 20, and a foiling or drainage surface 22 extending downstream in the machine direction (arrow 17) from a line 24 dividing the land section 20 and the foiling section 22, and away from the forming wire 14 at a foiling angle $\phi$. The leading edge 18 and the two surfaces 20 and 22 extend under the forming wire 14 the full width of the wire. During operation, referring to FIG. 1, the action of the drainage surface 22 of each foil 10 is to produce a suction beneath the moving wire 14 which draws water through the wire. The leading edge 18 of each foil 10 following the first foil in the sequence scrapes from the underside of the wire water that is drawn through the wire by the drainage surface of the immediately preceding foil.

In a preferred form, the foil has its first body 26 formed from a suitable material, such as a high density, high molecular weight polyethylene, this being a material that is known to be suitable for this purpose. The first body 26 is (in the present example) fitted with a mortise slot 16A which mates with a dovetail slide 16 (FIG. 1). It will be realized that other means to mount the foil on the support 12 may be used, the mounting means not forming any part of the present invention. The drainage surface 22 is formed on a top surface of the first body, and a forward surface 28 facing upstream as seen relative to the machine direction (indicated by the arrow 17) extends downward relative to the forming wire. A channel 40 in the first body 26 opens between the forward edge of the drainage surface 22 and the upper edge of the forward surface 28.

Figure 4:
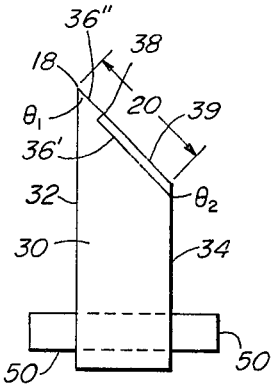
FIG. 4 is a section view of an insert according to one embodiment of the invention, which is illustrated in FIGS. 1 and 2.
Figure 5:
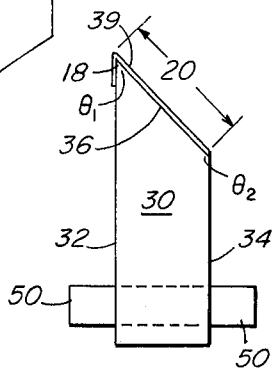
FIG. 5 is a section view of an insert according to a second embodiment of the invention.

Referring now in particular to FIGS. 4 and 5, an insert in the form of a second body 30 of elongated form has first and second wide sides 32 and 34 respectively which are substantially parallel to each other and a third side 36 joining the first side at an acute angle $\theta_1$ and joining the second side at an obtuse angle $\theta_2$. The leading edge 18 is the apex of the acute angle $\theta_1$. The land or wire supporting surface 20 of the foil is formed on the entire third side 36 of the insert 30. The second body 30 is supported in the channel slot 40 in the first body 26. When the second body 30 is installed in the first body 26 the first wide side 32 is oriented forward, and partly sticks out of the first body effectively extending the forward surface 28 to the leading edge 18, and the second wide side 34 is entirely covered by the material of the first body 26. The line 24 joining the second wide side 34 and the third side 36 at the obtuse angle $\theta_2$ becomes the line of demarcation between the land surface 20 and the drainage surface 22. At this line these two surfaces should preferably meet flush with each other, and the drainage surface 22 slopes away from the forming wire 14 at the foiling angle $\phi$, measured to this line 24. In practice, owing to the practical difficulties of maintaining dimensional tolerances, the forward edge of the drainage surface may be a small distance below the level of the land surface 20, relative to the forming wire (e.g.: 0.010 inch).

Figure 6:
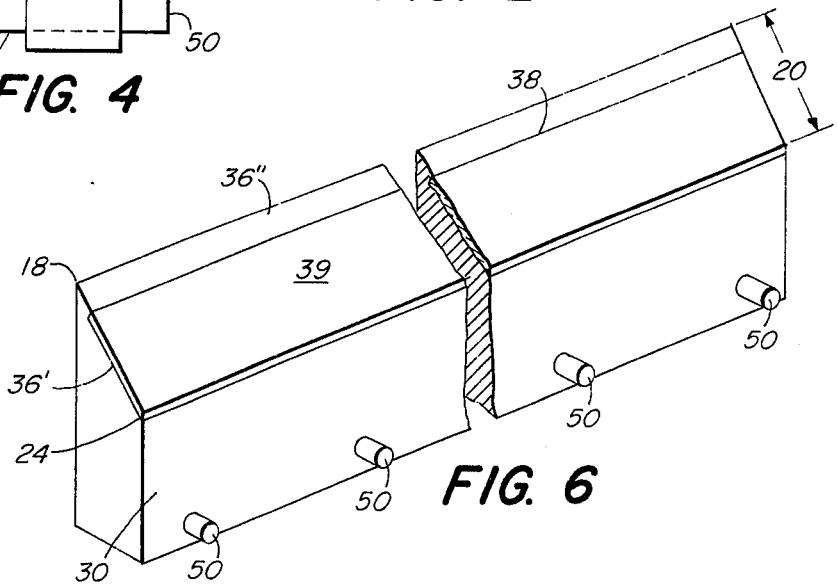
FIG. 6 is an isometric view of the insert of FIG. 4 showing certain structural details that are common to the embodiments of both FIGS. 4 and 5.
Figure 3:
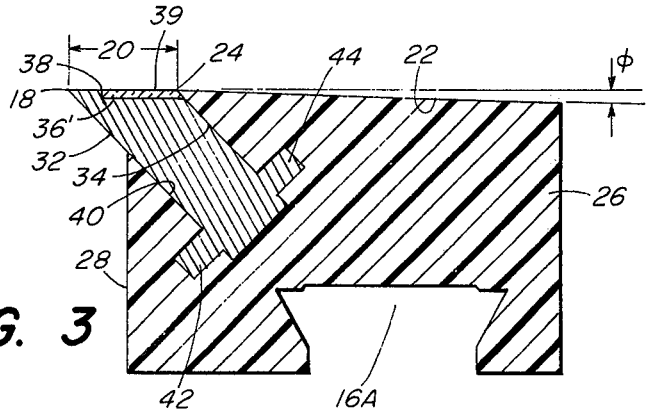
FIG. 3 is a section on line 3—3 of FIG. 2.

The second body 30 is fitted with retaining means 50 for holding the second body in the channel 40 against a force oriented to move the second body out of the channel through the opening between the drainage surface 22 and the forward surface 28 of the first body 26. These retaining means take the form, in the present example, of an array of discrete projections 50 spaced in a line along each of the first and second wide sides 32 and 34 respectively, as is shown in FIGS. 4, 5 and 6. To cooperate with the projections 50 the channel is fitted with first and second auxiliary slots 42 and 44 extending, along with the channel 40, the full length of the first body 26 beneath the forming wire 14 transverse to the machine direction 17. The channel 40 and the auxiliary slots 42, 44 all open through at least one end of the foil so that the second body 30 is slidably movable in its elongated direction within the channel 40, and can be installed in and removed from the first body 26 from at least one end thereof. To facilitate such installation and removal the projections 50 are dimensioned to fit more loosely within the auxiliary slots 42 and 44 than the second body 30 fits between the walls of the channel 40.

The third side 36 of the second body may be treated in various ways to provide wear resistance to the foil 10. In a preferred embodiment of the invention, illustrated in FIGS. 2, 3, 4 and 6, the third side has a stepwise drop in level along a recess line 38 running parallel to the edges of the third side, that is, parallel to the leading edge 18 and the line 24 which marks the trailing edge of the land surface 20. The resulting recessed portion 36′ of the third side is covered with a wear-resistant material 39 that is permanently affixed to the second body 30 and is harder than the material of the second body. The recessed portion 36′ may be formed by first planing, milling or grinding the third side 36 of the second body 30 to a desired depth, for example, 0.010 to 0.030 inch, leaving a wear land 36 inches about 3/32 inch wide between the leading edge 18 and the recess line 38. The wear-resistant material 39, which takes the form of a strip or layer running the full length of the foil 10, is preferably a material that may be applied in many ways, several of which are described in U.S. Pat. No. 3,703,019 - Bratt. Thus, for example, the wear-resistant material can be deposited on the second body 30 by thermally spraying a ceramic material onto the surface of the recess 36′ in powder or rod form, using as starting materials metal oxides, carbides, borides, silicates and mixed compositions thereof. Conventional ceramic materials used for thermal spraying are alumina, chromia, chromia-alumina, alumina-titania, nickel oxide, aluminum silicate, zirconia, calcium zirconate, zirconium silicate, magnesium zirconate, magnesium aluminate, tungsten carbide, chromium carbide, zirconium carbide, tantalum carbide, titanium carbide, zirconium diboride, chromium diboride, titanium diboride, molybdenum diboride and mixtures thereof. Other wear resistant materials such as a nickel, chromium, and boron metal alloy may be used. The wear resistant layer can be between about 0.010 inch and 0.030 inch thick. The wear-land 36 inches provides a break-in surface, and the wear-resistant material 39 preferably has its outer surface in the same plane as the wear land, which may be achieved by grinding or polishing away excess wear-resistant material after deposition.

FIG. 5 illustrates a second embodiment of the invention wherein the entire third surface 36 and a portion of the first wide side 32 adjacent the leading edge 18 of the second body 30 are covered with the wear-resistant material 39. Thus, the invention may use an insert 30 offering the properties of a foil having a land or wire supporting section 20 which is entirely covered with a hard wear-resistant material, or is only partly covered with such a material so as to leave a break-in surface or wear land 36 inches immediately adjacent to the leading edge 18.

The second body 30 can be made of any hard material having the desired properties of corrosion resistance and ability to accept the wear-resistant layer 39. Stainless steel, for example 316 Stainless Steel, is a preferred material. A corrosion-resistant alloy, such as Monel (trademark), may be used. The leading edge 18 realized in such a hard material provides an excellent skimming device for oncoming water on the underside of the forming wire 14. The ability to interchange the two parts 26 and 30 enables a more economic change of foiling angle $\phi$, since only a part of each foil 10 must then be changed, the part 30 providing the long-wearing land surface 20 being able to be on any of several foil bodies 26.

In practice the foils 10 must be long enough to extend the full width of the forming wire 14. This may be several hundred inches. Prior drainage foils with wear resistant inserts, as exemplified by Buchanan's Pat. No. 3,446,702, recognized a need to form the wear resistant material of a number of short segments, which have sharp edges at their ends, and that presents the problem of keeping all the segments at the same level to avoid cutting or tearing the under-side of the forming wire. In the present invention the wear resistant material 39 can flex with the second body 30 over long lengths, and will not fracture during handling of a foil or its parts 26, 30 prior to installation on the more rigid support means 12.

I claim:

1. For use in a paper machine having a traveling screen for supporting water-wet pulp during the drainage of water therefrom, an elongated drainage foil intended to extend lengthwise transversely under the full width of the screen and having a leading edge for initial contact with said screen, followed in the direction of travel of the screen by an upward-facing land surface in supporting relation thereto, followed in said direction of travel by a drainage surface diverging from the underside of the screen to control the drainage of water from said pulp, the improvement in said foil comprising, a first body defining said drainage surface and a second body defining all of said land surface from said leading edge to said drainage surface, said land surface being covered at least in part with a wear-resistant material that is permanently affixed to said second body and is harder than the material of said second body, an elongated channel running the length of the first body, said second body being removably disposed within said channel wherein said second body is an elongated slab of solid material having first and second wide sides substantially parallel to each other, and a third side joining the first side at an acute angle and joining the second side at an obtuse angle, said land surface being on said third side, said second body being installed in said first body with said first side oriented forward of said second side whereby said first and third surfaces meet at said acute angle to form the leading edge of said drainage foil, and said second and third surfaces meet at a line that coincides substantially with the forward edge of said drainage surface, said elongated channel in said first body has first and second side walls and a bottom wall and an elongated opening into the channel between the edges of said first and second side walls that are remote from said bottom wall, and first and second auxiliary slots extending in opposite directions, respectively, substantially perpendicularly into said first and second side walls, and having retainer means on said second body extending, respectively, from said first and second wide sides into said first and second auxiliary slots to retain said second body in said channel against force oriented to move said second body out of said channel through said elongated opening, and said retainer means comprises an array of discrete projections spaced in a line along each of said first and second wide sides.

2. A foil according to claim 1 wherein said third side and a portion of said first side immediately adjacent to said third side are covered with a wear resistant material.

3. A foil according to claim 1 wherein said third side has a step-wise change in level along a line running parallel to its edges, said line being nearer to said first side than to said second side, the portion of said third side between said line and said second side being covered with a wear-resistant material the outer surface of which is substantially co-planar with the portion of said third side between said line and said first side.

4. A foil according to claim 1 wherein said elongated channel and said auxiliary slots open through at least one end of said foil, and said second body is slidably movable in the elongated direction within said channel.

5. A foil according to claim 1 wherein said elongated channel and said auxiliary slots open through at least one end of said foil, and said second body is slidably movable in the elongated direction within said channel, said projections fitting more loosely within said auxiliary slots than said second body fits between said first and second side walls of said channel.

6. A foil according to claim 1 wherein said second body is made of a material that is harder than the material of said first body, for improved removal of water from the underside of said screen.

7. A foil according to claim 1 wherein said second body is made of a corrosion-resistant metal and said first body is made of a material that is more resilient than said metal, said leading edge being in said metal for improved removal of water from the underside of said screen.

* * * * *